United States Patent [19]

Billgren

[11] 4,044,516

[45] Aug. 30, 1977

[54] AIR TERMINAL BUILDING

[76] Inventor: Karl Lennart Billgren, Grev Magnigatan 4, 114 55 Stockholm, Sweden

[21] Appl. No.: 610,959

[22] Filed: Sept. 8, 1975

[51] Int. Cl.[2] ..... E04H 6/00

[52] U.S. Cl. ..... 52/174; 52/33; 52/236.2; 52/236.3

[58] Field of Search ..... 52/33, 169, 174–176, 52/236; 244/114 M

[56] References Cited

U.S. PATENT DOCUMENTS

| | | | |
|---|---|---|---|
| 1,843,640 | 2/1932 | Jackson | 52/175 |
| 2,638,636 | 5/1953 | Pool | 52/174 |
| 3,290,837 | 12/1966 | Weston | 52/175 |
| 3,427,766 | 2/1969 | Goldberg | 52/175 |
| 3,562,984 | 2/1971 | Merle | 52/175 |
| 3,571,990 | 3/1971 | Rossman | 244/144 M |
| 3,842,553 | 10/1974 | Billgren | 52/175 |
| 3,916,588 | 11/1975 | Magill | 52/175 |

*Primary Examiner*—Price C. Faw, Jr.
*Assistant Examiner*—Henry Raduazo
*Attorney, Agent, or Firm*—Smith, Harding, Earley & Follmer

[57] ABSTRACT

An air terminal building consisting of an arrival hall and a departure hall and one waiting hall possibly commonly used by both departing and arriving passengers. These halls are situated on separate above each other located levels and with the waiting hall on the top of the other levels and extending principally along the whole periphery of the building. The arrival and departure halls are located in the central portion of the building. The central portion also contains a baggage hall located between the arrival and the departure halls and commonly used for arriving and departing baggage and with direct access to the platform for the airplanes. The halls located in the center of the building are surrounded by wall elements which include therein or therebetween, all principal shafts necessary for the provision of and communication between the separated levels of the building, i.e. shafts for the installation of heating, water, sanitation, electricity and ventilation, lifts, escalators and others. On the same level as the baggage hall are also localities available for provision and service activities, catering a.s.o.

9 Claims, 10 Drawing Figures

49
D
C
B
A 14
26
23
22
32
31
28
29
30
39
24
15

15
10
25
12

AIR TERMINAL BUILDING

BACKGROUND OF THE INVENTION

The present invention refers to an air terminal building of more or less the same kind as one earlier known and described in the U.S. Pat. No. 3,842,553 which consists of an arrival hall and a departure hall and also a waiting hall possibly commenly used by both arriving and departing travellers. These halls are situated on separated above and each other located levels with the waiting hall on the top of the other level and extending principally along the whole periphery of the building, and with the departure hall located in the central portion of the building. In this previously known arrangement there are three arrival halls located peripherally outside the departure hall causing very unfavourable and splitted function of these arrival halls.

One desired purpose of the air terminal building thus known was to reduce the walking distances, and hence also the walking time, through the entire terminal building as well as to and from the platforms for the airplanes.

An additional wish was to keep the arriving and departing passengers streams through the building separated from each other as far as possible.

And another wish was to have an efficient handling of the arriving and departing baggage streams.

Unfortunately one has to admit that these desires have been complied with only to a very small extent. This applies especially to the baggage handling. However, it has to be stated that other important demands regarding i.e. the internal provision and services of the air terminal building, in fact, have not been provided for in the earlier known air terminal buiding.

SUMMARY OF THE INVENTION

Generally it is an object of the present invention to bring about an air terminal building in which the above stated inconveniences are avoided to the greatest possible extent and in fact practically completely eliminated. Primarily this has been achieved due to the fact that this air terminal building according to the invention contains one arrival hall in the center portion of the building and with one likewise located baggage hall and in addition hereto also localities for the provision and the services functions. Said baggage hall and localities are located on a separate level between the levels of the arrival and departure halls. By such an arrangement it is possible in accordance to prevailing circumstances to use simple, either completely or partly manual and/or more complicated automatic transport systems to obtain shortest transport distances possible, and also the most rational handling of the baggage of the passengers. In addition, the maintenance and the services functions for the entire terminal building are likewise as efficient, and working in such a way not to disturb the passengers in flow through the building. Another centributing addition to achieve this result is the arrangement of the location of the halls in the center of the building and their surrounding by walls which therein and/or therebetween contain all principal shafts required for the provision of and/or the communication between the separate levels of the building; i.e. shafts for the installation of heating, water, sanitation, electricity, ventilation, for lifts, escalators and suchlike.

Figure 1:
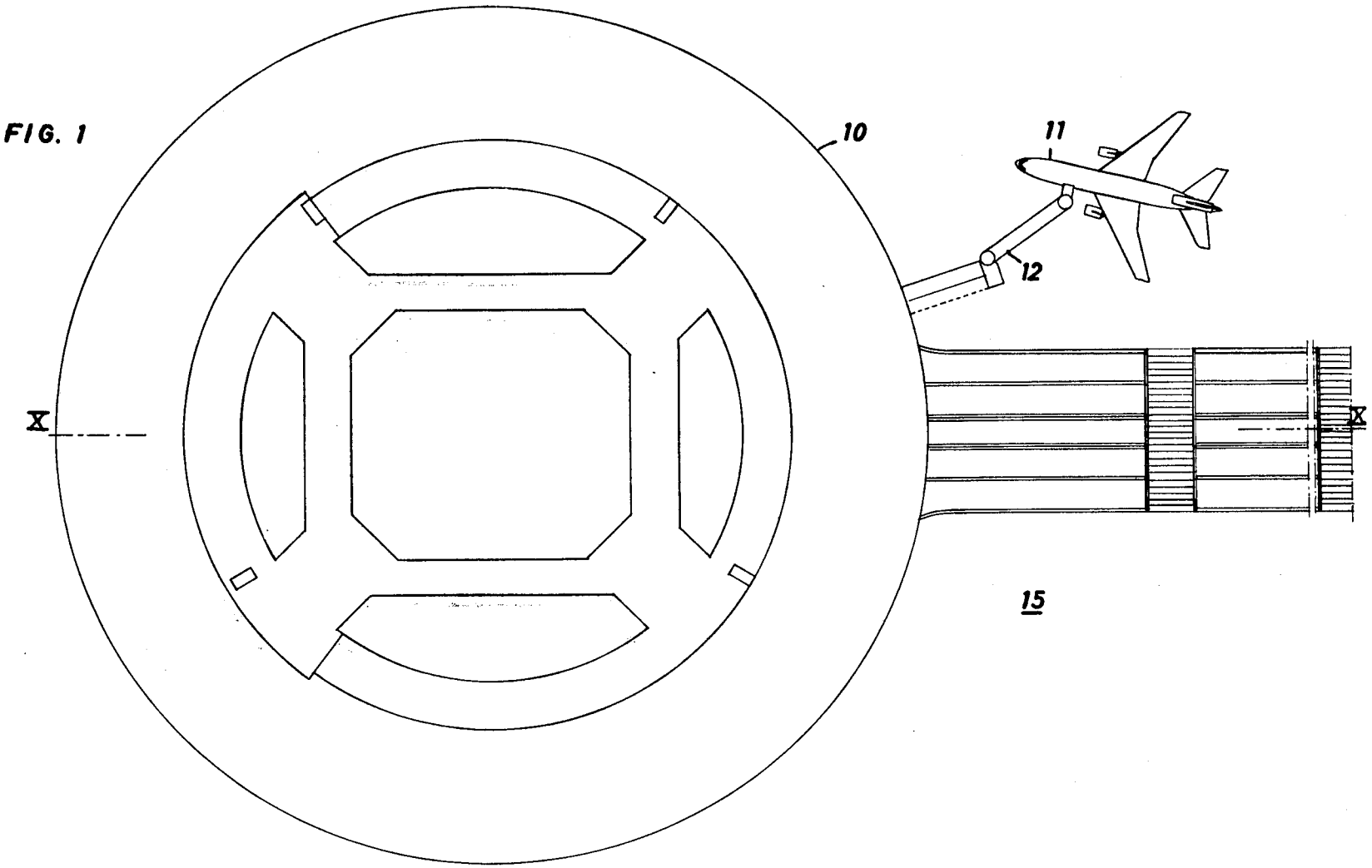
FIG. 1 is a plane view from above of an air terminal building according to the invention.
Figure 5:
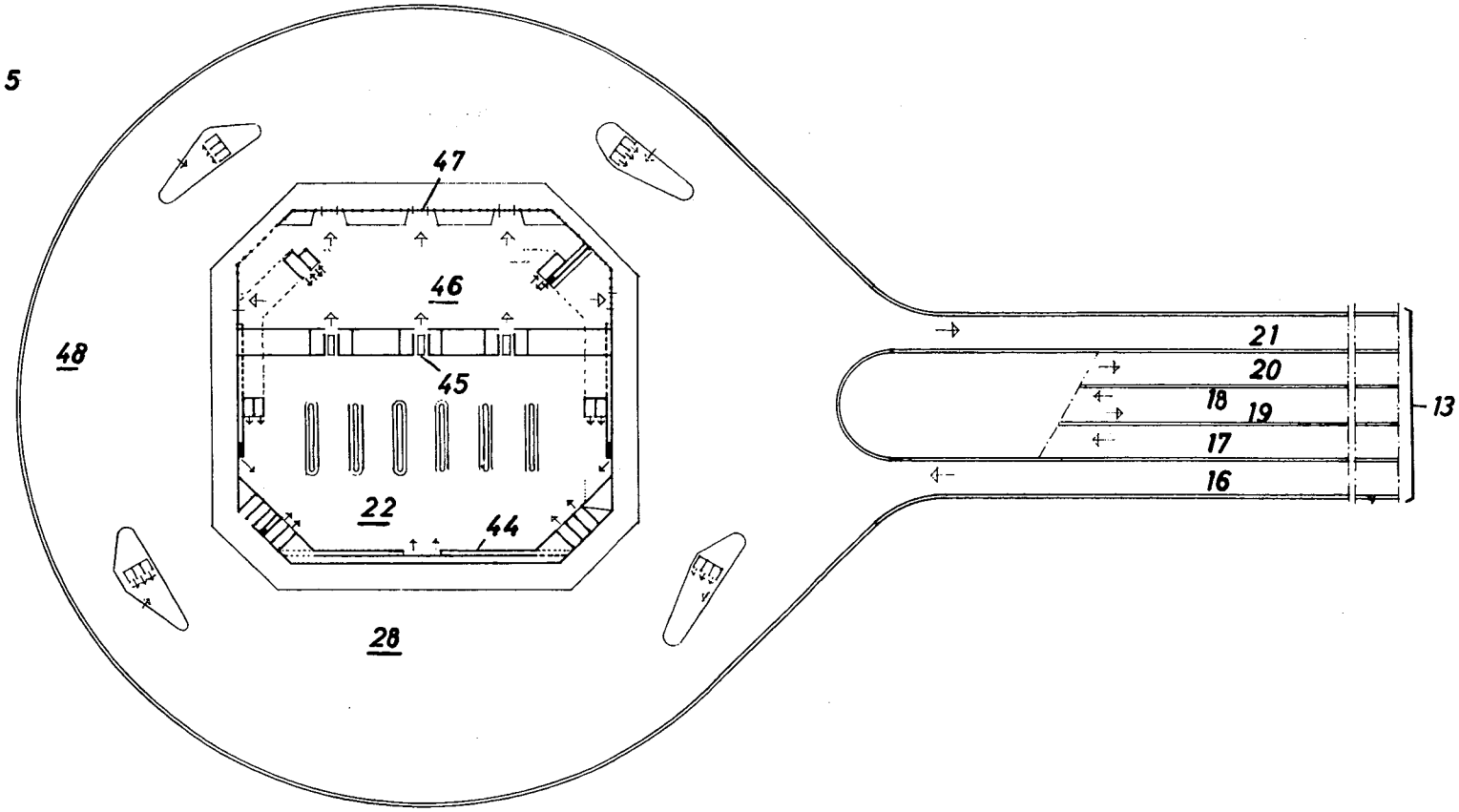
FIG. 5–8 show layout for levels A, B, C and D of the building respectively.
Figure 6:
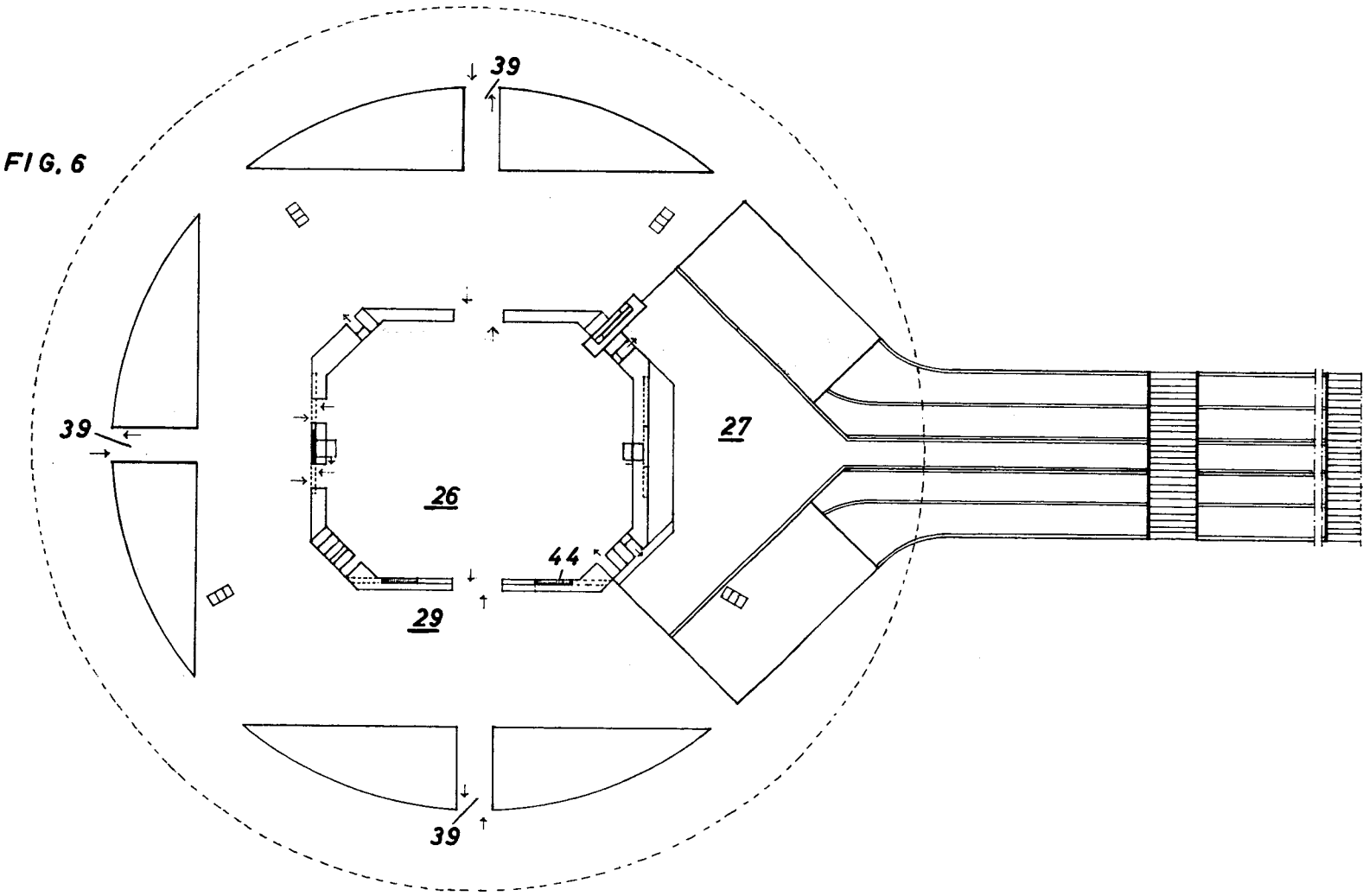
Figure 7:
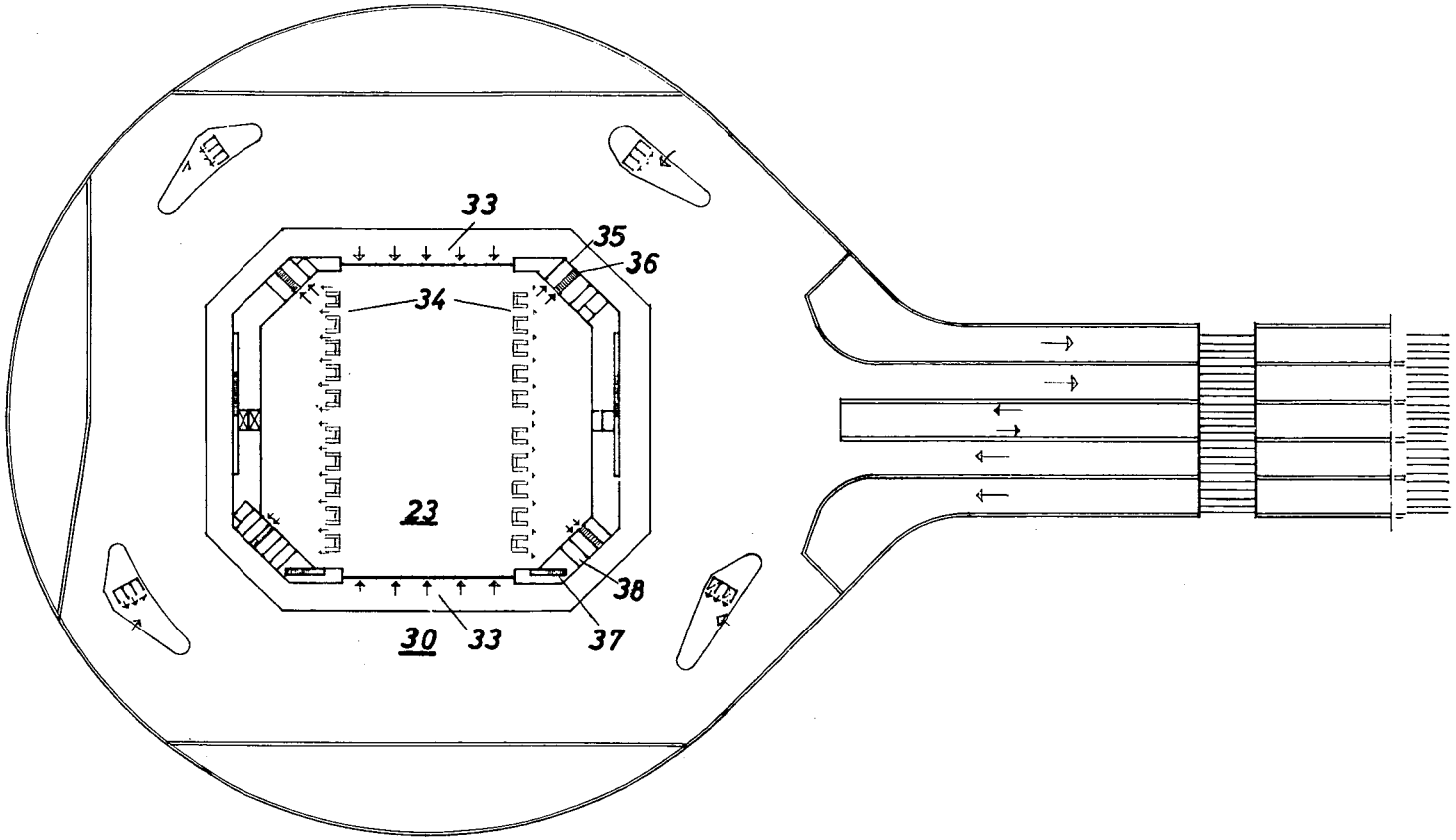
Figure 8:
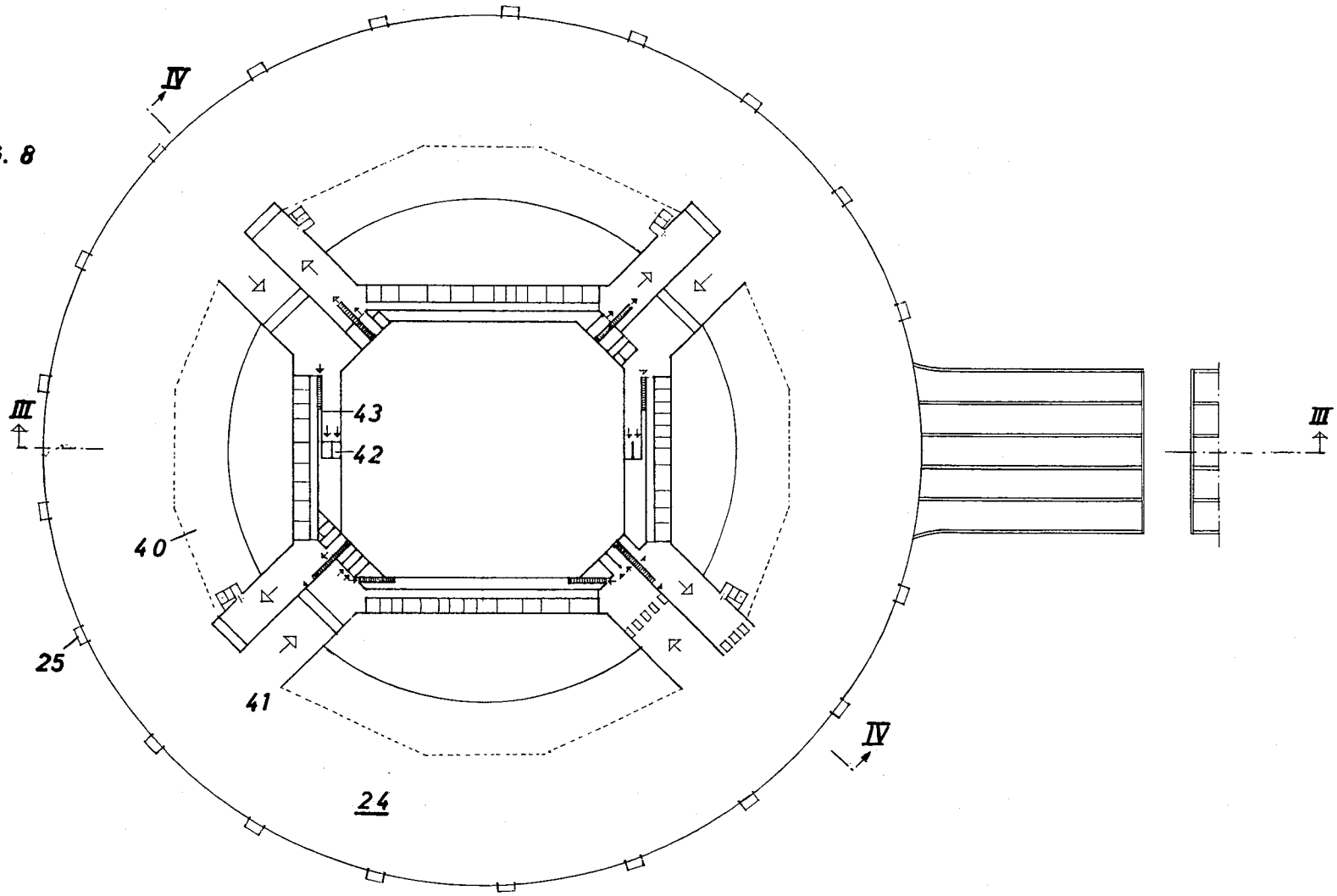

The air terminal building 10 according to FIG. 1 has a circular outer wall and the airplanes 11 are intended to be parked radially on the platform and connected to moveable and extendable boarding gangways or bridges 12 suitably adjustable in height and extending from the building. For the ground vehicles and pedestrian traffic to and from the air terminal building there is a main traffic road 13 which according to FIG. 3 is located in a tunnel 14 under the platform for the airplanes 15 and by means of entrance and exit ramps 16, 17, 18, 19, 20, 21 (FIG. 5) is connected to the traffic loops of the building, described more in details below.

Figure 4:
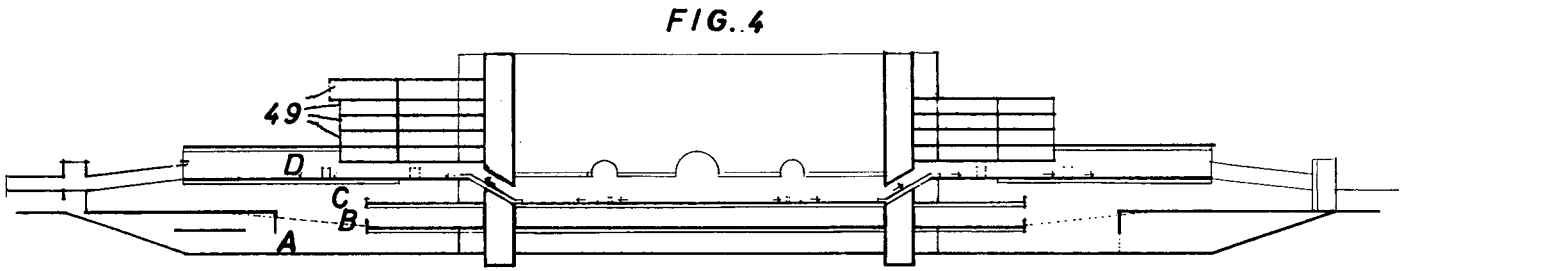
FIG. 4 is a cross-sectional view taken along the line IV — IV in FIG. 8.
Figure 3:
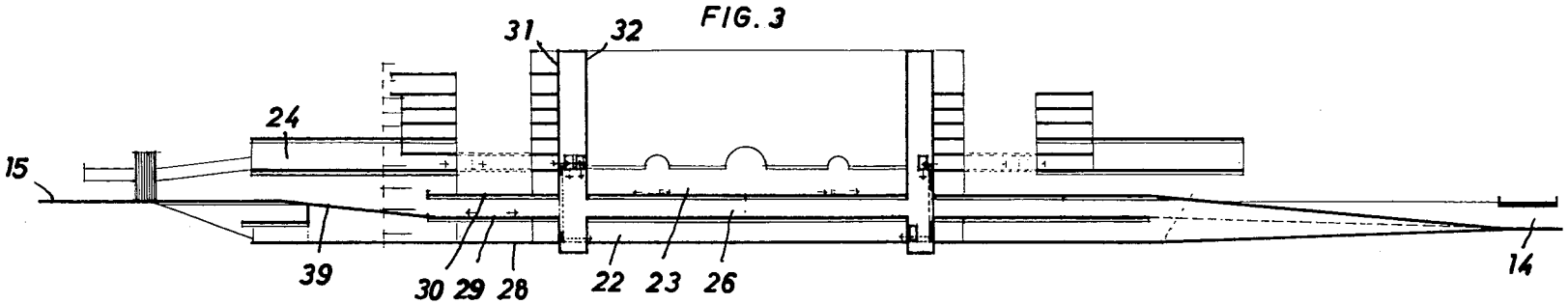
FIG. 3 is a cross-sectional view taken along the line III — III in FIG. 8.
Figure 2:
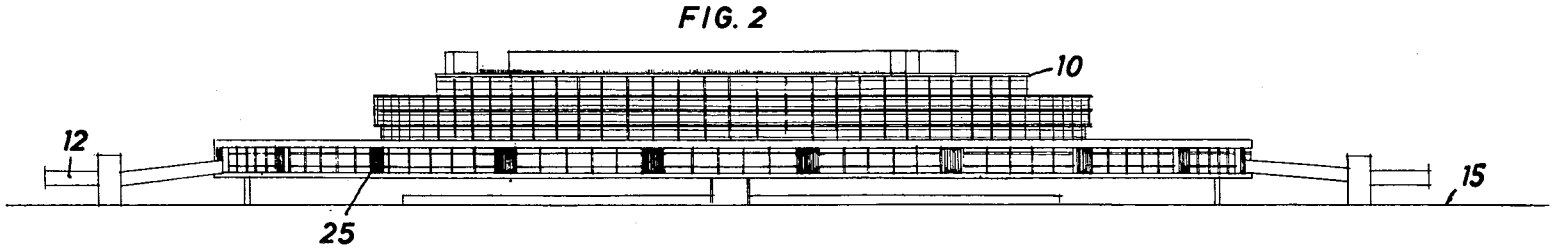
FIG. 2 is a side view of the air terminal building according to FIG. 1.

As shown in FIGS. 3 and 4 the air terminal building is composed of several levels of which only the lowest one, designated A, is completely below the surrounding ground or platform 15. The building in its central portion, shown in FIGS. 5-8 is of a principally square or rectangular cross-section which on the ground level, designated A, includes one arrival hall 22 and on the second level, designated C, a departure hall 23. On the top level, designated D, there is one ringshaped waiting hall 24 located outside the central portion of the building and extending along the periphery of the building. This waiting hall has in its outer wall openings or gates 25 leading to the gangways or bridges 12.

According to the invention the air terminal building has in its central portion a baggage hall 26 located between the levels of the arrival and departure halls 22, and 23 on the level, designated B. On the baggage level is all necessary localities 27 for the maintenance and services functions of the building and located as shown on FIG. 6.

Around the central portion of the building the above mentioned traffic loops are running consisting of side walks and roads 28, 29, 30 for all kinds of ground traffic. These traffic loops lie on the same level as each respective hall 22, 23, 26 and are through entrance and exit openings connected to each ones hall. Each ground traffic loop is connected to its corresponding entrance ramp either 16, 17, 18 and at the other end with its corresponding exit ramp either 19, 20, 21. This is of a very great importance and it is in this way possible to keep the different traffic streams completely separated from each other within the air terminal building. Especially advantageous is the fact that it is not only possible via the separate ramps, 18, 19 to come to and from the level 27 of the maintenance and services functions but also to reach from same level to any part of the air terminal building without getting into confict with or disturb arriving and departing passengers within the building. This advantage is obtained mainly due to the fact that in the buiding its communication system works in a vertical direction and takes place through the shafts arranged in or between the through passing walls 31, 32 constituting the outer partitions of the arrival, departure and baggage halls 22, 23, 26 located in the center of the building. As shown on FIGS. 5, 6 and 7 the arrival, the departure and the baggage halls are mainly of square or rectangular form. These halls, however, can of course be of any other polygonal form.

The traffic loop 30 arranged outside the departure hall 23 is provided with docking space 33 (FIG. 7) for vehicles which are to leave passengers or goods at the building. Numbers of entrances are from this docking space leading into the central portion of the departure hall 23 as shown by arrows in FIG. 7. In the departure hall 23 suitably symmetrical in respect to the line x — X on FIG. 1, are the check-in desks 34 of flow through type arranged. After having left their baggage the departing passengers continue out towards the periphery of the hall to the lifts 35 or the escalators 36 for further transport to the waiting hall 24, situated on the level D, FIG. 8, and where also the passport controls can be located. Several lifts and escalators arranged in such a way so that each passenger can choose the most suitable and shortest way to the gate and docking place of his airplane. The baggage of the departing passengers is by means of conveyors 37 or lifts 38 from the check-in desks brought down to the underlying baggage hall 26 and from there by means of trucks taken via traffic ramps 39, conveyors, or in any other suitable manner carried the shortest way directly out to the airplane standing on the platform 15.

The ring shaped waiting hall 24 commonly used by both arriving and departing passengers, runs along the inner periphery of the building and where public service space 40 can be converted into e.g., restaurants, shops, tax-free shops, rest rooms, VIP rooms, offices for administration, briefing etc. for the benefit of the passengers.

Passengers arriving by airplanes into the waiting hall 24 are lead through a special passage 41 to the lifts 42 or the escalators 43 arranged to bring them directly down to the arrival hall 22 through a passage to the customs and passport controls 45. The baggage of the arriving passengers is transported from the airplane by means of trucks via one of the traffic ramps 39 or by means of conveyors to the baggage hall 26 and from there by means of conveyors 44 to the arrival hall 22 where the passenger thus can fetch his baggage near and immediately before the passage to the customs controls 45.

The passenger leaves the arrival hall 22 and passes through a meeting hall 46 and continues through one of its exits 47 and may via the traffic loops 28 located immediately outside the exits and leave the building either walking to the parking place or use one of the collective transportation means, taxi, bus or meeting cars. Outside the baggage hall 26 there is a great space 27 which as mentioned above may be suitable to be used for the maintenance and services functions of the building. Outside arrival hall 22 there is an equally great space 48 which may be used as a deposit of goods or for long or short term parking, etc.

Figure 9:
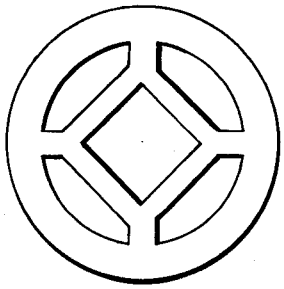
FIGS. 9 and 10 show alternative air terminal building embodiments with the outer contour or the building circular and elliptical, respectively.
Figure 10:
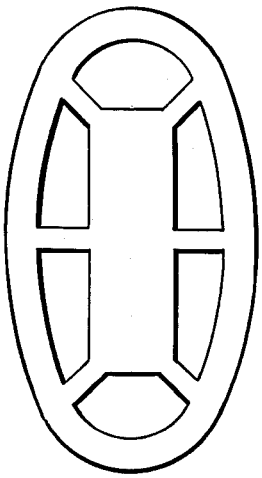

The air terminal building described above is to be considered only as one embodiment of the present invention. Thus it is not necessary, although it may be advantageous for accoustical conditions to have the building circular in shape. The outer contour of the building may also be elliptical, as shown in FIG. 10, or of any other polygonal form as illustrated in FIGS. 1 and 9. However, the building may also include more than four stories. On top of waiting hall 24 there may be arbitrary numbers of floors 49, such additional stories could be used for administration, personal residences, hotels, restaurants, etc. On the roof of the building there could be an observation deck or landing place for hepicopters etc.

The air terminal building according to the invention shows great flexibility as to the layout of each level, for rearrangement of various functions as well as for expansion. For example, the passport controls for departing passengers can alternatively be placed on level C, connecting the upper end of the lift 35 and escalator 36. Arriving passengers can alternatively be directed from the respective gate 25 directly, by means of the escalators or stairs, to the appropriate arrival hall 22. Any conflict between the departing and arriving air passengers is thereby totally avoided. By means of variable and lower docks 5 it is also possible to direct the arriving passengers directly through gates on level A to the arrival hall 22. Also the building can, if so desired, easily be altered for so called gate check-in, i.e. with the check-in desks at the respective gates.

I claim:

1. An air terminal building having a central portion and an outer peripheral portion, an arrival hall for passengers arriving at the building by airplane, a departure hall for passengers departing the building by airplane, a baggage hall commonly used for baggage of both arriving and departing passengers, said arrival, departure and baggage halls being located on different levels in said central portion of said building with said baggage hall being located on a level between the levels of said arrival and departure halls, and a waiting hall commonly used for both arriving and departing passengers, said waiting hall being located in said outer peripheral portion of said building, said outer peripheral portion being located at a level above the levels of said arrival, departure and baggage halls.

2. A building according to claim 1, characterised therein that the arrival hall is located below the baggage hall.

3. A building according to claim 2, characterised by shafts through and passing along the whole building at the periphery of the halls located in the center of the building and arranged for the necessary provision of, and the communication function between the different stories, i.e. shafts for the provision of heating, water, sanitation, electricity and ventilation as well as for lifts, escalators and suchlike communication means.

4. A building according to claim 3, characterised therein, that the level of the baggage hall consists also of localities for maintenance and services functions required for the building.

5. A building according to claim 1, characterized by three traffic loops running along the periphery of the central portion of the building and joining a common main road, each of said traffic loops being located at the same level as its corresponding arrival, departure or baggage hall.

6. A building according to claim 1, characterized therein that the outer contour of the building is polygonal in shape.

7. A building according to claim 1, characterized therein that the arrival, departure and baggage halls are of flow-through type as to the passengers and the baggage.

8. A building according to claim 1, characterized therein that the outer contour of the building is circular in shape.

9. A building according to claim 1, characterized therein that the outer contour of the building is elliptical in shape.

* * * * *